US009789487B2

(12) United States Patent
Karpiloff et al.

(10) Patent No.: US 9,789,487 B2
(45) Date of Patent: Oct. 17, 2017

(54) INJECTION MOLDED TRAY FOR BLOOD COLLECTION TUBES

(71) Applicant: Becton, Dickinson and Company, Franklin Lakes, NJ (US)

(72) Inventors: Kenneth Karpiloff, Mamaroneck, NY (US); Michael Iskra, Bridgewater, NJ (US); Gregory L. Lusardi, Hackettstown, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 14/420,547

(22) PCT Filed: Jul. 17, 2013

(86) PCT No.: PCT/US2013/050843
§ 371 (c)(1),
(2) Date: Feb. 9, 2015

(87) PCT Pub. No.: WO2014/028159
PCT Pub. Date: Feb. 20, 2014

(65) Prior Publication Data

US 2015/0182968 A1 Jul. 2, 2015

Related U.S. Application Data

(60) Provisional application No. 61/683,940, filed on Aug. 16, 2012.

(51) Int. Cl.
*B01L 9/06* (2006.01)

(52) U.S. Cl.
CPC ..... *B01L 9/06* (2013.01); *B01L 2200/12* (2013.01); *B01L 2300/0829* (2013.01); *B01L 2300/0851* (2013.01); *B01L 2300/0858* (2013.01)

(58) Field of Classification Search
CPC ..... B01L 9/06; B01L 9/54
See application file for complete search history.

(56) References Cited

U.S. PATENT DOCUMENTS 5,508,005 A 4/1996 Mathus
6,533,133 B2 * 3/2003 Liu ..... B01L 9/06 211/74

(Continued)

FOREIGN PATENT DOCUMENTS

CN 2589067 Y 12/2003
CN 201070588 Y 6/2008

(Continued)

*Primary Examiner* — Paul Hyun
(74) *Attorney, Agent, or Firm* — The Webb Law Firm

(57) ABSTRACT

A tray for holding a plurality of blood collection tubes is disclosed. The tray includes a deck portion, a sidewall portion disposed about at least a portion of a perimeter of the deck portion, a first well defined within the deck portion and a second well defined within the deck portion, with each well configured to receive a blood collection tube therein. Each well defines an aperture therein and the tray includes at least one structural rib interconnecting the first well and the second well without extending into an aperture of the first well or the second well. The tray may include a plurality of wells, each well defining an aperture therein, and a plurality of structural ribs, each structural rib interconnecting at least a portion of the plurality of wells without extending into an aperture of any of the wells.

22 Claims, 7 Drawing Sheets

(56) References Cited

U.S. PATENT DOCUMENTS

| | | | | |
|---|---|---|---|---|
| 2004/0200580 | A1 | 10/2004 | Guthrie et al. | |
| 2007/0212775 | A1* | 9/2007 | Cohen | B01L 3/50851 435/288.4 |
| 2008/0053940 | A1 | 3/2008 | Whalen et al. | |
| 2008/0078119 | A1* | 4/2008 | Hansen | A01G 9/1066 47/66.5 |
| 2009/0065458 | A1 | 3/2009 | Murray | |
| 2012/0257953 | A1 | 10/2012 | Williams et al. | |
| 2014/0014654 | A1* | 1/2014 | Gerner | A61M 5/008 220/23.83 |

FOREIGN PATENT DOCUMENTS

| | | | |
|---|---|---|---|
| JP | 445543 | U | 4/1992 |
| JP | 910605 | A | 1/1997 |
| JP | 2010538924 | A | 12/2010 |

* cited by examiner

INJECTION MOLDED TRAY FOR BLOOD COLLECTION TUBES

BACKGROUND OF THE INVENTION

1. Field of the Invention

The present invention relates generally to trays for storing specimen collection containers and, more particularly, to plastic injection molded trays for storing blood collection tubes.

2. Description of Related Art

It is common for medical specimens to be collected by a technician in a collection container for subsequent testing. Specimen collection containers, such as blood collection tubes, are typically cylindrical in shape and include a semispherical bottom portion. Blood collection tubes often have an additive disposed within the tube, such as EDTA, heparin, acid citrate dextrose, and/or oxalate. Blood collection tubes may be evacuated and/or non-evacuated and are generally sterilized. Blood collection tubes are typically stored and transported in trays configured to hold each blood collection tube upright. These trays are generally rectangular or square in shape and include wells or apertures formed therein to hold the blood collection tubes. Typically, blood collection tube trays are constructed from expanded polystyrene (EPS), which is rarely recycled due to logistical and economic factors and therefore adds to waste in landfills. Another shortcoming of current EPS trays is they use a substantial amount of material relative to the number of tubes they hold and are bulkier than necessary.

In the medical field, it is important to lower material costs to reduce operational overhead. Therefore, a replacement for standard EPS trays is needed that allows for easy recycling and/or multiple uses. A need further exists for a tray for holding blood collection tubes that is inexpensively produced, easily inspected for damage and defects, and operates efficiently in a medical setting.

There presently exists a need for a tray for storing and transporting blood collection tubes that is lightweight, has a high strength to weight ratio, is inexpensive to manufacture, and is easily recyclable.

SUMMARY OF THE INVENTION

Accordingly, there is a general need for a blood collection tube tray that has a reduced cost to manufacture, tighter tolerances, lower weight, increased strength, and greater ease of recyclability than prior art blood collection tube trays.

In accordance with an embodiment of the present invention, a tray for holding a plurality of blood collection tubes includes a deck portion, and a sidewall portion disposed about at least a portion of a perimeter of the deck portion. A first well is defined within the deck portion and a second well is defined within the deck portion, each well being configured to receive a blood collection tube therein, and each well defining an aperture therein. The tray includes at least one structural rib interconnecting the first well and the second well without extending into the aperture of either of the first well or the second well.

In certain configurations, the deck portion, the sidewall portion, the first well, the second well, and the at least one structural rib are co-formed. The tray may formed of injection molded polymeric material.

Each well may include a substantially semispherical bottom portion. The substantially semispherical bottom portion may include a truncated region. In certain configurations, each substantially semispherical bottom portion defines the aperture therein. The tray may also include a plurality of wells, each well defining an aperture therein, and a plurality of structural ribs, each structural rib interconnecting at least a portion of the plurality of wells without extending into an aperture of any of the wells. Optionally, the plurality of structural ribs may include at least one inter-well rib and at least one sidewall-connecting rib.

In certain configurations, an inter-well rib is defined along a first plane and the sidewall-connecting rib is defined along a second plane, the first plane being different from the second plane. The first plane may be anti-parallel with respect to the second plane. The plurality of structural ribs may include at least one rib disposed along a first plane, at least one rib disposed along a second plane, at least one rib disposed along a third plane, and at least one rib disposed along a fourth plane, wherein each of the first plane, the second plane, the third plane, and the fourth plane are anti-parallel with respect to the other of the first plane, the second plane, the third plane, and the fourth plane.

At least one structural rib may be disposed along a first plane, and the tray may also include a second structural rib disposed along a second plane, wherein the at least one structural rib and the second structural rib each contact a common well. At least one structural rib is disposed on an underside of the deck portion. The deck portion may include an underside and the tray may define a bottom surface, wherein the at least one structural rib extends between the underside of the deck portion and the bottom surface.

In accordance with another embodiment of the present invention, a tray for holding a plurality of blood collection tubes includes a deck portion having an underside, and a sidewall portion disposed about at least a portion of a perimeter of the deck portion. A plurality of wells is defined within the deck portion, each well configured to receive a blood collection tube therein. At least one structural rib interconnects at least two of the plurality of wells, wherein the at least one structural rib extends between the underside of the deck portion and at least two of the plurality of wells.

In certain configurations, the tray is formed of injection molded polymeric material. Each well may define an aperture therein, and the at least one structural rib connects at least two of the plurality of wells without extending into the aperture of either well. The tray may also include a plurality of structural ribs having at least one inter-well rib and at least one sidewall-connecting rib. The inter-well rib is defined along a first plane and the sidewall-connecting rib is defined along a second plane, the first plane being anti-parallel to the second plane.

In accordance with another embodiment of the present invention, a tray for holding a plurality of blood collection tubes includes a deck portion having an underside, and a sidewall portion disposed about at least a portion of a perimeter of the deck portion. A plurality of wells is defined within the deck portion, each well configured to receive a blood collection tube therein. The tray also includes a first plurality of structural ribs interconnecting at least a portion of the plurality of wells, wherein each rib of the first plurality of structural ribs extends between the underside of the deck and a bottom surface of the tray. The tray further includes a second plurality of structural ribs interconnecting at least a portion of the plurality of wells and the sidewall portion, wherein each rib of the second plurality of structural ribs extends between the underside of the deck and the sidewall portion.

In certain configurations, the tray is formed of injection molded polymeric material. Each well may define an aperture therein, and each rib of the first plurality of structural ribs connects at least two of the plurality of wells without extending into the aperture of either well. Each of the structural ribs of the second plurality of ribs interconnects at least one well of the plurality of wells and a portion of the sidewall. Each of the structural ribs of the first plurality of structural ribs interconnects at least two of the plurality of wells.

Further details and advantages of the invention will become clear upon reading the following detailed description in conjunction with the accompanying drawing figures, wherein like parts are designated with like reference numerals throughout.

DETAILED DESCRIPTION OF THE EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Figure 7:
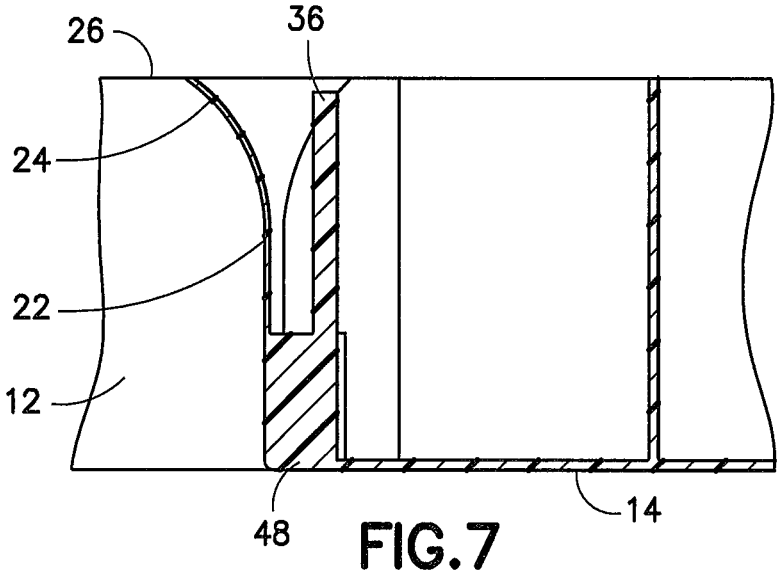
FIG. 7 is a cross-sectional view of the tray for holding blood collection tubes of FIG. 1 taken along line 7-7 of FIG. 6 in accordance with an embodiment of the present invention.
Figure 8:
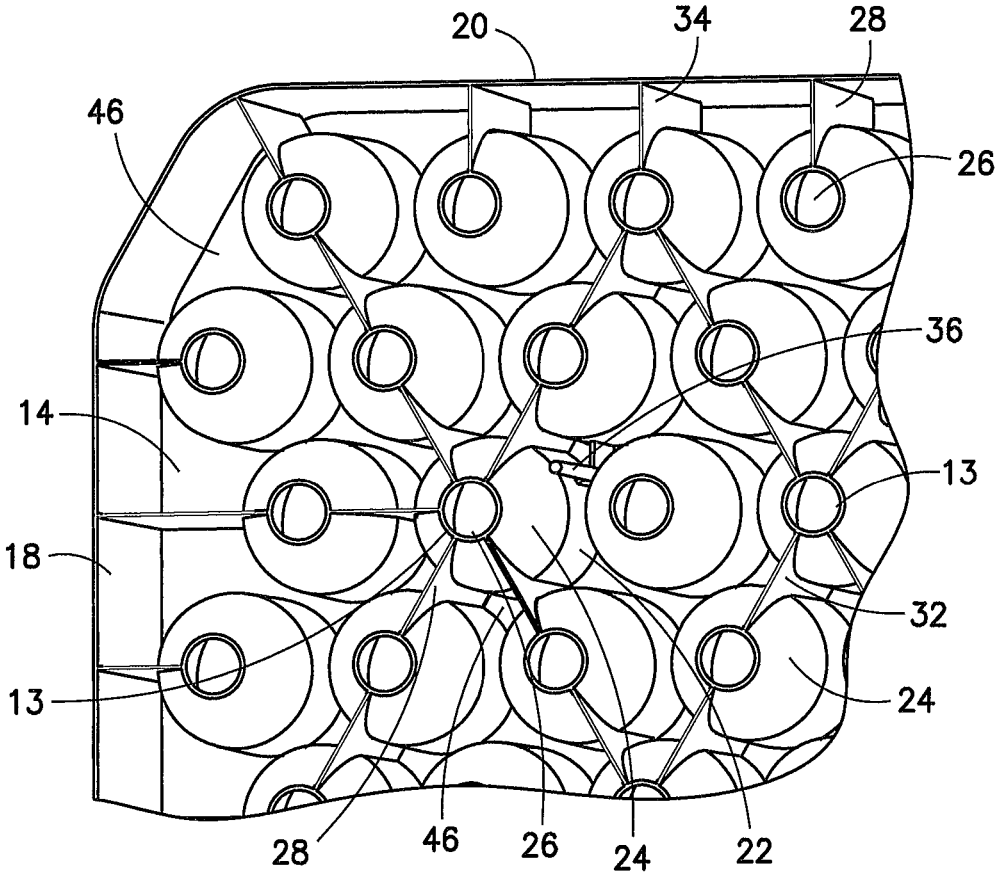
FIG. 8 is a partial perspective view of the bottom of the tray for holding blood collection tubes of FIG. 5 in accordance with an embodiment of the present invention.
Figure 9:
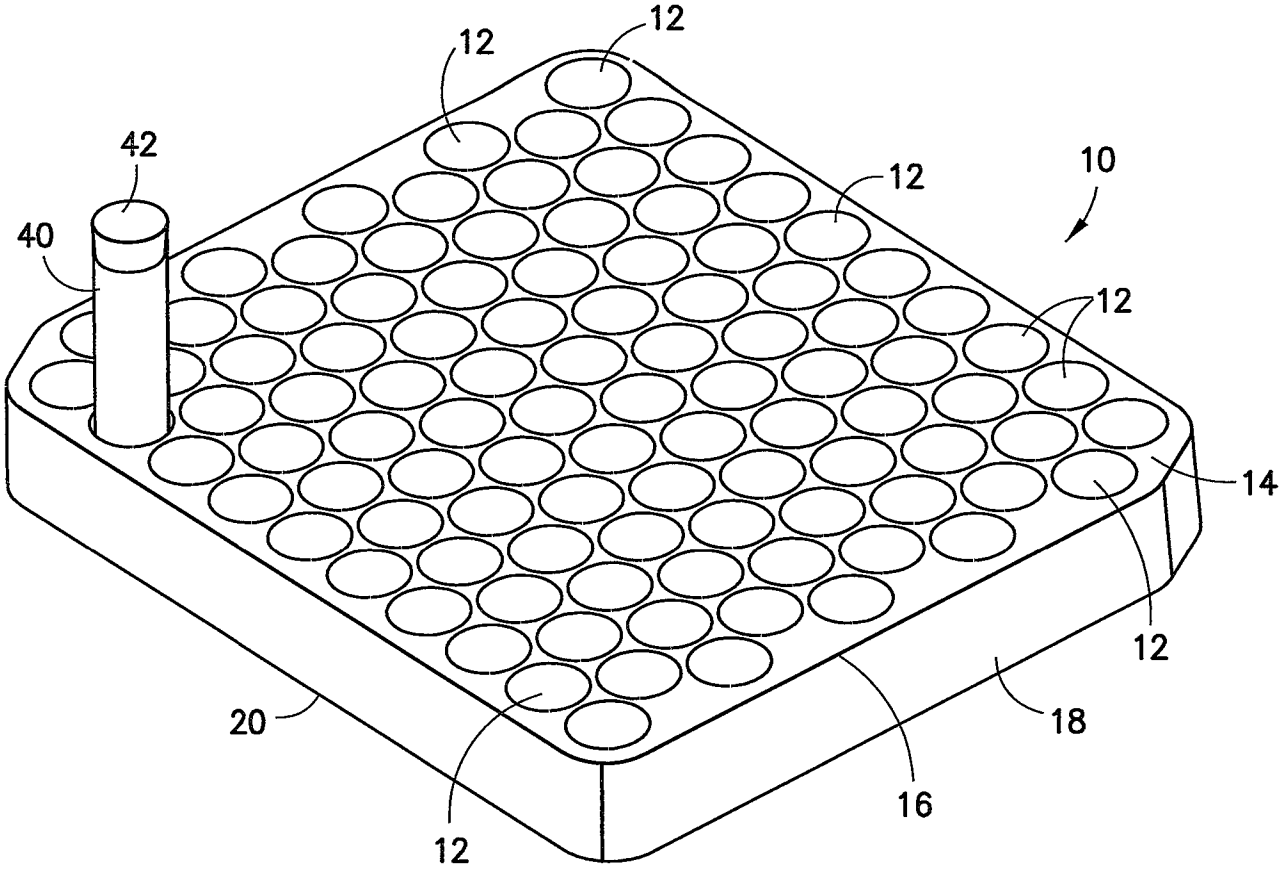
FIG. 9 is a perspective view of the tray for holding blood collection tubes of FIG. 1 being used to hold an exemplary blood collection tube in accordance with an embodiment of the present invention.

FIGS. 1-9 show a tray, generally indicated as 10, configured to hold a plurality of blood collection tubes, as shown specifically in FIG. 9. Tray 10 is contemplated to be used to transport and/or store blood collection tubes. The tray 10 could be used for packaging empty blood collection tubes for sale, transporting blood collection tubes containing samples, storing blood collection tubes, or aiding in any activity where holding at least one blood collection tube is beneficial or desired.

The tray 10 includes a plurality of wells 12 disposed through a deck portion 14. Deck portion 14 is defined by a top edge 16 which connects to a sidewall portion 18. Sidewall portion 18 is bounded by top edge 16 and a bottom edge 20. Sidewall portion 18 may extend completely around edge 16. Alternatively, sidewall portion 18 can be partially discontinuous about the deck portion 14. It is contemplated herein that deck portion 14 extends in a substantially horizontal plane and sidewall portion 18 depends therefrom in a plane substantially perpendicular to the deck portion 14.

Figure 1:
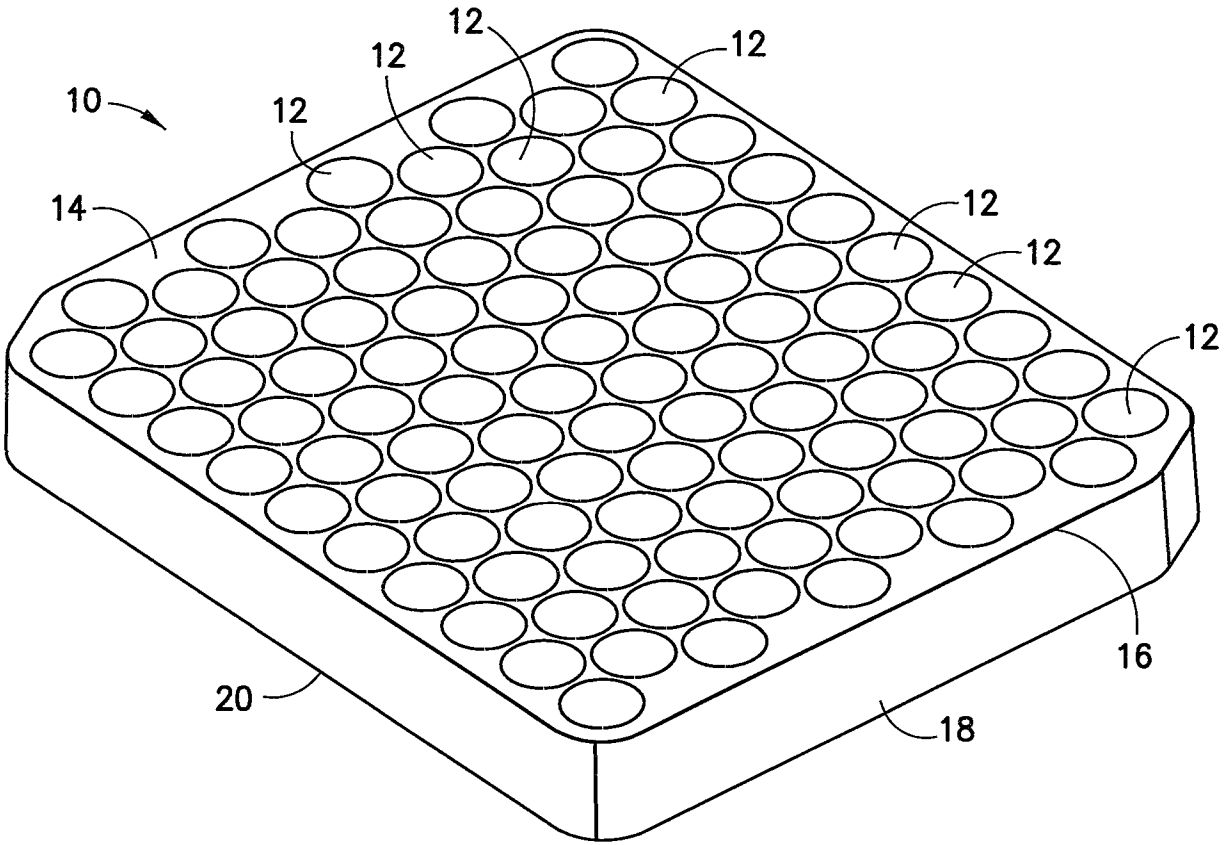
FIG. 1 is a perspective view of a tray for holding blood collection tubes in accordance with an embodiment of the present invention.
Figure 2:
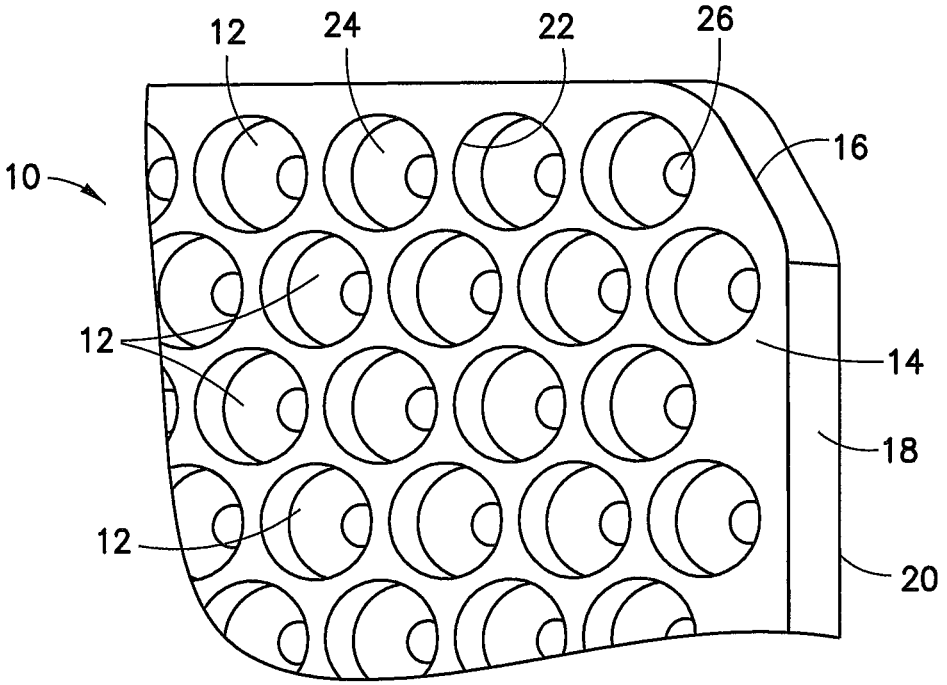
FIG. 2 is a partial perspective view of the tray for holding blood collection tubes of FIG. 1 in accordance with an embodiment of the present invention.
Figure 4:
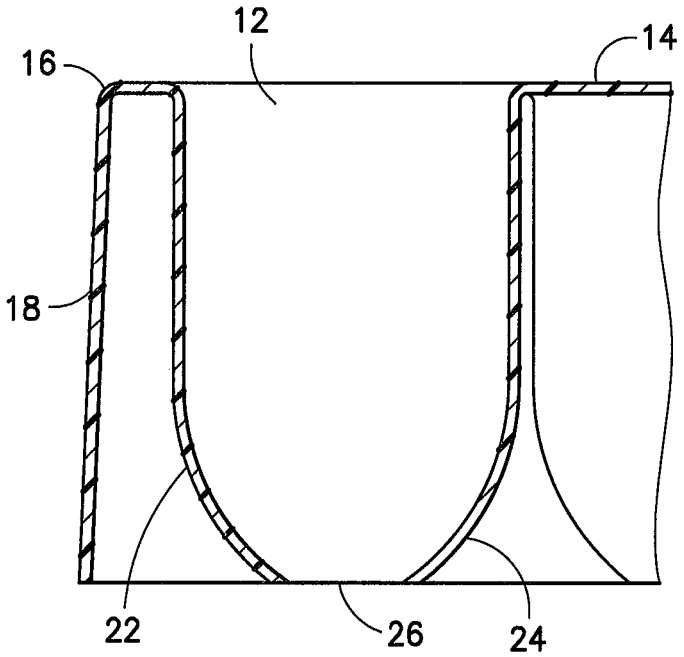
FIG. 4 is a cross-sectional view of the tray for holding blood collection tubes of FIG. 1 taken along line 4-4 of FIG. 3 in accordance with an embodiment of the present invention.
Figure 3:
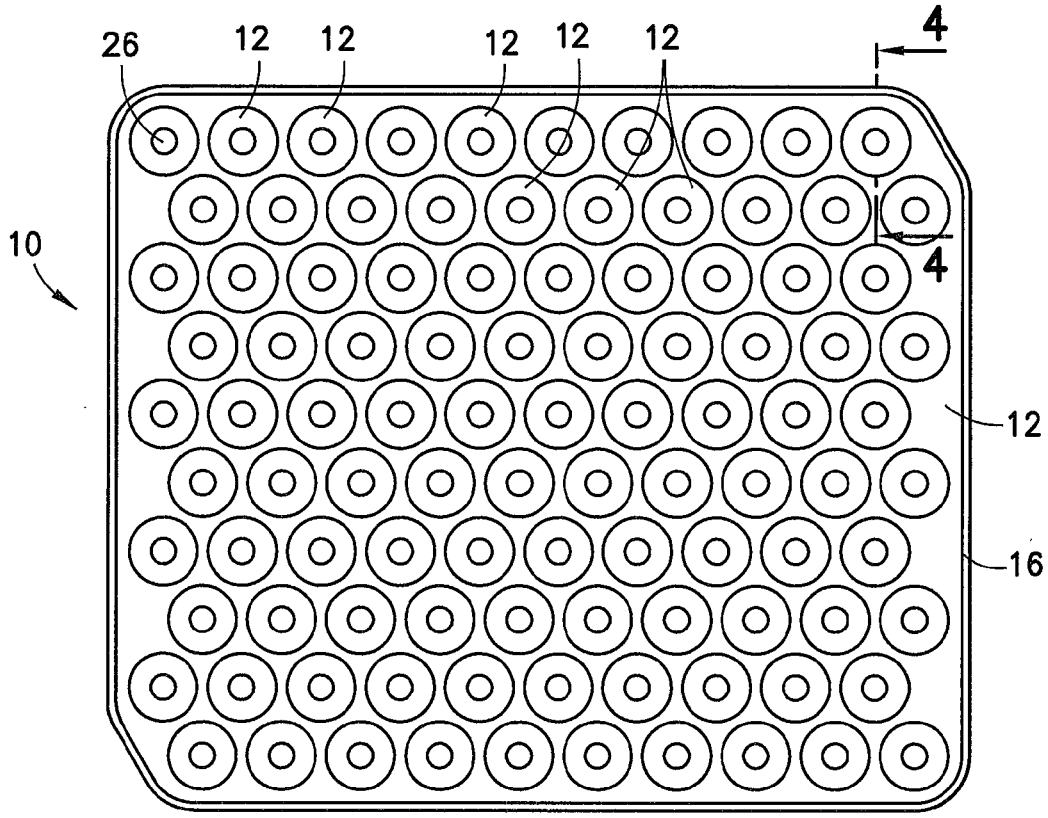
FIG. 3 is a top view of the tray for holding blood collection tubes of FIG. 1 in accordance with an embodiment of the present invention.

Wells 12 of the tray 10 may be defined as substantially cylindrical recesses defined within tray 10 and extending through the deck portion 14. Each well 12 includes an internal sidewall 22 extending away from the deck portion 14 and toward the bottom edge 20 of the tray 10. Each well 12 forms a truncated semispherical bottom portion 24 with an aperture 26 defined therethrough at the truncation of truncated semispherical bottom portion 24, as shown in FIG. 4. The truncation of semispherical bottom portion 24 that forms aperture 26 may be coplanar with bottom edge 20. In one configuration, each aperture 26 may be substantially circular in shape.

Figure 5:
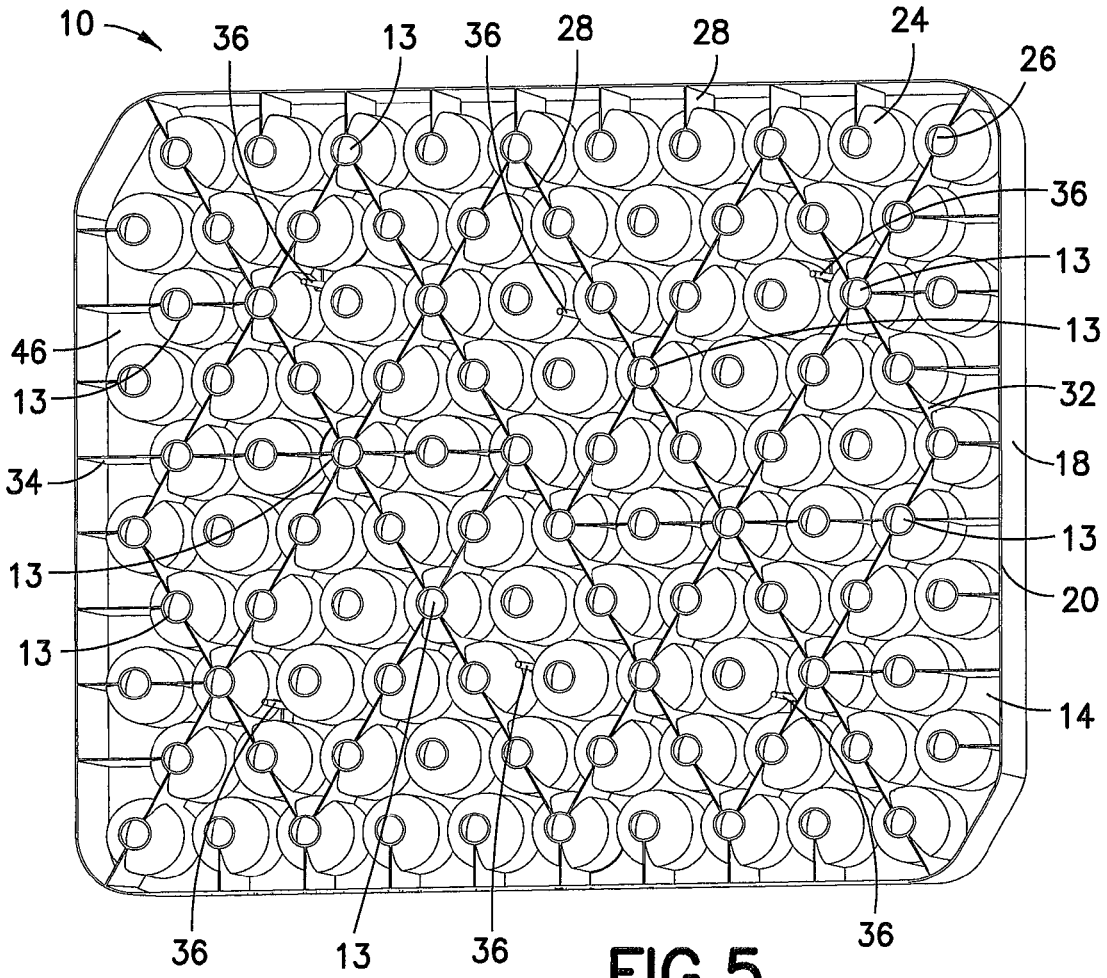
FIG. 5 is a bottom perspective view of the tray for holding blood collection tubes of FIG. 1 in accordance with an embodiment of the present invention.
Figure 6:
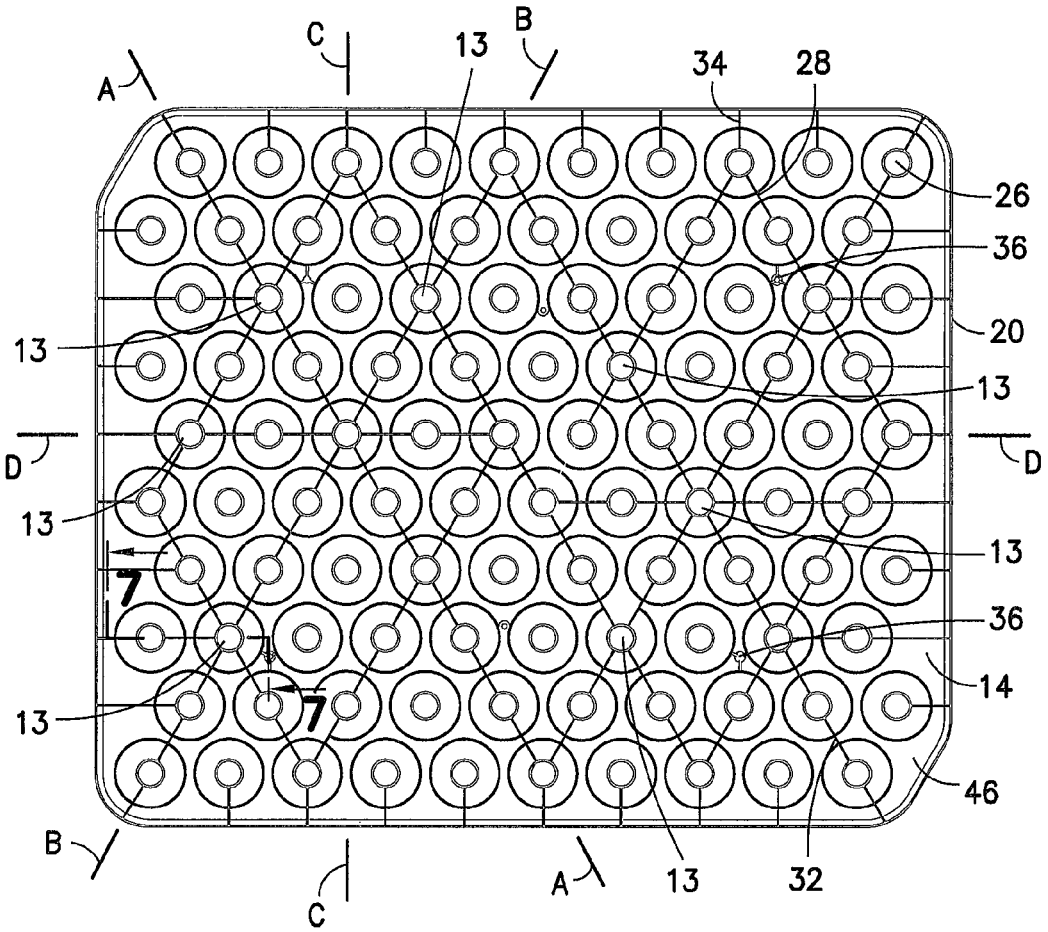
FIG. 6 is a bottom view of the tray for holding blood collection tubes of FIG. 1 in accordance with an embodiment of the present invention.

Referring specifically to FIGS. 5-8, the tray 10 includes a plurality of structural ribs 28 for supporting and interconnecting wells 12 and for increasing the strength and rigidity of the overall tray 10. Structural ribs 28 may be substantially planar and, in the illustrated embodiments, extend between portions of adjacent wells 12 and between the underside 46 of deck portion 14 and the bottom edge 20. In another embodiment, the structural ribs 28 may extend between the sidewall portion 18 and a well 12 and between the underside 46 of deck portion 14 and the bottom edge 20, as shown in FIGS. 5 and 8. A structural rib 28 that connects two wells to each other is an inter-well rib 32, while a structural rib 28 that connects a well 12 to a sidewall 22 is a sidewall-connecting rib 34.

In one embodiment, the bottom edge 20, portions of the structural ribs 28, and the apertures 26 of each well 12 may all terminate along the same plane. In another embodiment, each structural rib 28 may be oriented substantially parallel to, or disposed along, one of a first plane A, a second plane B, a third plane C, and a fourth plane D each being defined by lines A, B, C, and D respectively, as shown in FIG. 6. In another configuration, at least a portion of the plurality of ribs 28 may be provided in a substantially parallel orientation.

Tray 10 may have an inter-well rib 32 defined along a first plane A and a sidewall-connecting rib 34 defined along a second plane B, the first plane A being different from the second plane B. Tray 10 may have an inter-well rib 32 defined along a first plane A and a sidewall-connecting rib 34 defined along a second plane B. In one embodiment, the first plane A is anti-parallel and/or anti-perpendicular with respect to the second plane B. The plurality of ribs may comprise at least one inter-well rib 32 defined along a first plane A, and at least one inter-well rib 32 defined along a second plane B, the first plane A being different from the second plane B. The plurality of ribs 28 may comprise at least one inter-well rib 32 defined along a first plane A, and at least one inter-well rib 32 defined along a second plane B. In one embodiment, the first plane A is anti-parallel and/or anti-perpendicular with respect to at least one of the second plane B, the third plane C, and the fourth plane D. In accordance with another embodiment, at least one inter-well rib 32 defined along a first plane A and at least one inter-well rib 32 defined along a second plane B are anti-parallel and/or anti-perpendicular with respect to each other. In a further configuration, the first plane A and the second plane B are anti-parallel and anti-perpendicular with respect to the third plane C and the fourth plane D.

At least a portion of the plurality of structural ribs 28 may be substantially parallel. The plurality of structural ribs 28 may include at least one rib 28 disposed along or parallel to the first plane A, at least one rib 28 disposed along or parallel to the second plane B, at least one rib 28 disposed along or parallel to the third plane C, and at least one rib 28 disposed along or parallel to the fourth plane D, wherein each of the first plane A, the second plane B, the third plane C, and the fourth plane D are anti-parallel and/or anti-perpendicular to the other of the first plane A, the second plane B, the third plane C, and the fourth plane D. At least one structural rib 28 may be parallel to or disposed along the first plane A, and at least one structural rib 28 parallel to or disposed along the second plane B intersects at least a portion of a common well 13, as shown in FIGS. 5, 6, and 8. The plurality of structural ribs 28 may be disposed on an underside 46 of the deck portion 14. The deck portion 14 may include an underside 46 and the tray 10 defines a bottom surface, wherein the plurality of structural ribs 28 extends substantially from the underside 46 of the deck 14 to the bottom surface. The first plurality of structural ribs 28 may interconnect at least a portion of the plurality of wells, wherein each rib of the first plurality of structural ribs 28 is connected directly to the deck portion 14, and a second plurality of structural ribs may interconnect at least a portion of the plurality of wells 12 and the sidewall portion 18, wherein each rib of the second plurality of structural ribs 28 is connected directly to the deck portion 14 and the sidewall portion 18.

In another embodiment, at least one well 12 is connected to at least two ribs and is considered to be a common well 13 relative to the at least two structural ribs 28. The tray 10 of the present invention may include a plurality of common wells for enhancing the overall strength and rigidity of the tray 10.

The plurality of wells 12 of the tray 10 may be formed into rows, specifically a plurality of rows at least partially offset with respect to an adjacent row, as shown in FIGS. 1-3, 5-6, and 8-9. The rows of the plurality of wells 12 may be arranged in a non-offset pattern or another arrangement. Structural ribs 28 that connect to a well 12 may bisect the well 12 but the structural ribs 28 do not extend into the aperture 26. The structural ribs only extend into the internal sidewall 22 of the respective well 12. Structural ribs 28 may extend from underside 46 of deck portion 14, along internal sidewall 22, and along semispherical bottom portion 24, terminating at aperture 26. Structural ribs 28 may extend between and interconnect at least two adjacent wells 12 without extending into the aperture 26 of either well 12. In this manner, the aperture 26 of each well 12 is unobstructed by any structural rib 28 and each well 12 may be bounded by a structural rib 28 along the semispherical bottom portion 24 up to, but not extending into, the aperture 26. The structural rib 28 may also extend to either sidewall portion 18 or to another well 12, as shown in FIG. 8. While the structural ribs 28 are shown bisecting, connecting at the center of a well 12, the structural ribs 28 may connect at any point along the internal sidewall 22 of any well 12.

Tray 10 as shown in FIGS. 1-9 may be constructed by a plastic injection molding process. Specifically, plastic injection molding allows for thin wall construction, such as a wall thickness of between 0.001 inches and 0.005 inches, such as about 0.003 inches thick. Plastic injection molding also allows for quick manufacturing time and optimized strength to weight ratio. Referring to FIG. 4 specifically, thin wall construction of internal sidewall 22, deck 14, and sidewall 18 can be seen from the hatched cross section of these portions. In one embodiment, the tray 10 of the present invention may be formed of a thermoplastic elastomer, such as polypropylene and/or polyurethane. Most thermoplastics also have the benefit of being easily recyclable.

Referring specifically to FIGS. 5-8, tray 10 as shown is envisioned to be constructed by a plastic injection molding process. Tray 10 may be formed by injecting a plastic into a mold (not shown, but as is conventionally known in the art), then releasing the tray 10 after the plastic has set. Plastic enters the cavity of the mold at a plurality of discrete locations simultaneously via a plurality of gates 36. The tray 10 of the present invention may be formed by plastic entering the cavity of the mold via six gates 36. While more or fewer gates could be used, six gates have been found to be effective for forming thin walls in a tray with around one hundred wells, as shown in FIGS. 5-8. The number of gates can be scaled up or down to adjust for constructing larger or smaller trays. It has been found that using one gate per every 15-20 wells can be effective to provide optimized thin wall construction. The advantages of thin wall construction include the production of a lighter tray, the use of less material, and less set-time in the mold. Therefore, this arrangement allows for shorter cycling times in the plastic molds and shorter production times than constructing trays with thicker walls. This arrangement is also capable of optimizing the tray to have the highest strength to weight ratio.

Referring specifically to FIG. 7 which shows a cross section along line 7-7 of FIG. 6, a cross section of gate 36 is clearly shown. During manufacturing, plastic is injected into gate 36 and this plastic flows into a pooling portion 48 and then throughout the cavity of the mold until the cavity has been filled. The plastic then stays in the mold, usually under pressure, until the plastic has set. The tray 10 is then ejected from the mold and excessive plastic may be removed to finish the tray 10. Pooling portion 48 enables the plastic to evenly flow to and through all of the portion of the mold. After manufacturing, pooling portion 48 is an area of increased strength relative the directly surrounding portions of the tray 10.

Referring specifically to FIG. 9, which shows tray 10 for holding blood collection tubes being used to hold a blood collection tube 40, tray 10 can be used to hold one or more blood collection tubes 40 with conventional stoppers 42.

While several embodiments of a tray for holding blood collection tubes were described in the foregoing detailed description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are embraced within their scope.

What is claimed is:

1. A tray for holding a plurality of blood collection tubes, the tray comprising:

a deck portion;

a sidewall portion disposed about at least a portion of a perimeter of the deck portion;

a first well defined within the deck portion and a second well defined within the deck portion, each well including a sidewall adapted to receive at least a portion of a blood collection tube therein, the sidewall extending from the deck portion toward a bottom surface of the tray and forming a curved bottom portion, the curved bottom portion of each well defining an aperture therein;

at least one structural rib interconnecting the first well and the second well and extending from the deck portion along the sidewall of each well to the curved bottom portion of each well without extending into the aperture of either of the first well or the second well; and at least one pooling portion extending partially from the deck portion toward the bottom surface of the tray forming an area of increased strength relative to the deck portion located adjacent to the at least one pooling portion.

2. The tray of claim 1, wherein the deck portion, the sidewall portion, the first well, the second well, and the at least one structural rib are co-formed.

3. The tray of claim 1, wherein the tray is formed of injection molded polymeric material.

4. The tray of claim 1, wherein the bottom portion of each well is substantially semispherical.

5. The tray of claim 4, wherein the substantially semispherical bottom portion comprises a truncated region.

6. The tray of claim 1, further comprising a plurality of wells, each well defining an aperture therein, and a plurality of structural ribs, each structural rib interconnecting at least a portion of the plurality of wells without extending into an aperture of any of the wells.

7. The tray of claim 6, wherein the plurality of structural ribs comprises at least one inter-well rib and at least one sidewall portion-connecting rib.

8. The tray of claim 7, wherein the inter-well rib is defined along a first plane and the sidewall portion-connecting rib is defined along a second plane, the first plane being different from the second plane.

9. The tray of claim 8, wherein the first plane and the second plane are non-parallel.

10. The tray of claim 6, wherein the plurality of structural ribs comprises at least one rib disposed along a first plane, at least one rib disposed along a second plane, at least one rib disposed along a third plane, and at least one rib disposed along a fourth plane, wherein each of the first plane, the second plane, the third plane, and the fourth plane are non-parallel to the other of the first plane, the second plane, the third plane, and the fourth plane.

11. The tray of claim 1, wherein the at least one structural rib is disposed along a first plane, and further comprising a second structural rib disposed along a second plane, wherein the at least one structural rib and the second structural rib each contact a common well.

12. The tray of claim 1, wherein the at least one structural rib is disposed on an underside of the deck portion.

13. A tray for holding a plurality of blood collection tubes, the tray comprising:

a deck portion having an underside;

a sidewall portion disposed about at least a portion of a perimeter of the deck portion;

a plurality of wells defined within the deck portion, each well including a sidewall adapted to receive at least a portion of a blood collection tube therein, the sidewall extending from the deck portion toward a bottom surface of the tray and forming a curved bottom portion having a bottom surface;

at least one structural rib interconnecting at least two of the plurality of wells, wherein the at least one structural rib extends from the deck portion along the sidewall of each well to the curved bottom portion of each well; and at least one pooling portion extending partially from the deck portion toward the bottom surface of the tray forming an area of increased strength relative to the deck portion located adjacent to the at least one pooling portion.

14. The tray of claim 13, wherein the tray is formed of injection molded polymeric material.

15. The tray of claim 13, wherein each well defines an aperture therein, and the at least one structural rib connects at least two of the plurality of wells without extending into the aperture of either well.

16. The tray of claim 13, further comprising a plurality of structural ribs having at least one inter-well rib and at least one sidewall portion-connecting rib.

17. The tray of claim 16, wherein the inter-well rib is defined along a first plane and the sidewall portion-connecting rib is defined along a second plane, and the first plane is non-parallel to the second plane.

18. A tray for holding a plurality of blood collection tubes, the tray comprising:

a deck portion having an underside;

a sidewall portion disposed about at least a portion of a perimeter of the deck portion;

a plurality of wells defined within the deck portion, each well including a sidewall configured to receive at least a portion of a blood collection tube therein, the sidewall extending from the deck portion toward a bottom surface of the tray and forming a curved bottom portion;

a first plurality of structural ribs interconnecting at least a portion of the plurality of wells, wherein each rib of the first plurality of structural ribs extends between the underside of the deck along the sidewall of each well to the curved bottom portion of each well;

a second plurality of structural ribs interconnecting at least a portion of the plurality of wells and the sidewall portion, wherein each rib of the second plurality of structural ribs extends between the underside of the deck and the sidewall portion; and at least one pooling portion extending partially from the deck portion toward the bottom surface of the tray forming an area of increased strength relative to the deck portion located adjacent to the at least one pooling portion.

19. The tray of claim 18, wherein the tray is formed of injection molded polymeric material.

20. The tray of claim 18, wherein each well defines an aperture therein, and wherein each rib of the first plurality of structural ribs connects at least two of the plurality of wells without extending into the aperture of either well.

21. The tray of claim 18, wherein each of the structural ribs of the second plurality of structural ribs interconnects at least one well of the plurality of wells and a portion of the sidewall portion.

22. The tray of claim 18, wherein each of the structural ribs of the first plurality of structural ribs interconnects at least two of the plurality of wells.

* * * * *